US011143473B1

(12) United States Patent
Kim et al.

(10) Patent No.: US 11,143,473 B1
(45) Date of Patent: Oct. 12, 2021

(54) FRAME ASSEMBLY FOR PISTOL

(71) Applicant: DASAN MACHINERIES CO., LTD, Jeollabuk-do (KR)

(72) Inventors: Byung Hak Kim, Jeonju-si (KR); Jong Bum Kim, Jeonju-si (KR); In Tae Kang, Iksan-si (KR)

(73) Assignee: DASAN MACHINERIES CO., LTD., Jeollabuk-do (KR)

( * ) Notice: Subject to any disclaimer, the term of this patent is extended or adjusted under 35 U.S.C. 154(b) by 0 days.

(21) Appl. No.: 17/095,911

(22) Filed: Nov. 12, 2020

(30) Foreign Application Priority Data

Sep. 22, 2020 (KR) ..... 10-2020-0122184

(51) Int. Cl.

| | |
|---|---|
| ***F41A 11/00*** | (2006.01) |
| ***F41A 3/66*** | (2006.01) |
| ***F41C 23/16*** | (2006.01) |
| ***F41C 23/10*** | (2006.01) |

(52) U.S. Cl.
CPC ..... *F41A 11/00* (2013.01); *F41C 23/10* (2013.01); *F41C 23/16* (2013.01)

(58) Field of Classification Search
CPC ..... F41A 3/66; F41A 11/00; F41C 23/10
See application file for complete search history.

(56) References Cited

U.S. PATENT DOCUMENTS

| | | | | |
|---|---|---|---|---|
| 5,655,326 | A | 8/1997 | Levavi et al. | |
| 6,993,864 | B1 | 2/2006 | O'Clair et al. | |
| 8,156,677 | B2 | 4/2012 | Glock | |
| 10,254,059 | B1 * | 4/2019 | Fellows | F41A 3/66 |
| 10,809,036 | B2 * | 10/2020 | Harrigan | F41A 11/00 |
| 2009/0071053 | A1 | 3/2009 | Thomele et al. | |
| 2014/0007479 | A1 | 1/2014 | Glock | |
| 2015/0059221 | A1 * | 3/2015 | Bero | F41A 3/66 42/16 |
| 2018/0100716 | A1 * | 4/2018 | Thomas | F41A 3/40 |
| 2018/0202737 | A1 * | 7/2018 | Ferguson | F41A 11/02 |
| 2019/0033025 | A1 * | 1/2019 | Wolf | F41C 23/10 |
| 2019/0107363 | A1 * | 4/2019 | Harrigan | F41A 11/00 |
| 2019/0154369 | A1 * | 5/2019 | Kim | F41C 23/10 |

FOREIGN PATENT DOCUMENTS

| | | | | |
|---|---|---|---|---|
| DE | 102018120040 | A1 * | 2/2020 | F41A 19/11 |
| KR | 10-1845051 | B1 | 5/2018 | |
| WO | WO-2020142761 | A1 * | 7/2020 | F41C 23/14 |

* cited by examiner

*Primary Examiner* — Reginald S Tillman, Jr.
(74) *Attorney, Agent, or Firm* — Rabin & Berdo, P.C.

(57) ABSTRACT

Provided is a frame assembly for a pistol. The frame assembly includes a lower frame having a grip formed at a lower side and an upper frame that is assembled on the lower frame and is assembled to a slide. The lower frame has a mounting projection which has a predetermined length and projects upward to a predetermined height in a direction to face the upper frame. The upper frame has a mounting groove which has a predetermined depth and into which the mounting projection is inserted in a direction to face the lower frame. The lower frame and the upper frame are assembled together by a screw which is fastened to penetrate the mounting groove and the mounting projection in this order from an inner side of the upper frame.

5 Claims, 10 Drawing Sheets

FRAME ASSEMBLY FOR PISTOL

BACKGROUND OF THE INVENTION

Field of the Invention

The present invention relates to a frame assembly for a pistol, and more specifically, to a frame assembly for a pistol which has a structure improved to have an easy and strong assembly between a grip part (hereinafter, referred to as a 'lower frame') and a rail (hereinafter, referred to as an 'upper frame'), to which a slide is joined, of the frame assembly.

Description of the Related Art

In general, a frame assembly for a pistol is integrally formed integrally with a rail on which a slide is assembled. However, in this case, there is a problem that the entire frame for pistol must be replaced unnecessarily when damages to the rail part occurs frequently.

In order to solve this problem, the applicant has developed a frame assembly for pistol (Korean Patent Registration No. 10-1845051, a frame for a reinforced plastic pistol with a metal rail having an improved structure, hereinafter referred to as a 'Patent Literature') which can easily separate and replace only the damaged rail part if necessary. In addition, if necessary, a handle part of the frame for pistol is made of a light plastic material and a rail part is made of a material with high rigidity such as a metal, so that they are mutually assembled to each other.

The frame for pistol disclosed in the Patent Literature includes a lower frame made of a reinforced plastic material and having a handle formed at its lower portion; and an upper frame assembled onto the lower frame while being assembled to the slide and made of a metal material, wherein the lower frame includes a first support positioned in front of the handle to support a bottom surface of the upper frame, and a second support positioned behind the handle to support a rear surface of the upper frame; and the upper frame is assembled to the lower frame such that the bottom and rear surfaces of the upper frame are supported by the first and second supports, and the upper frame has a front rail and a rear rail that are integrally formed on its upper surface, the front and rear rails being assembled to the slide.

In the frame for pistol of the Patent Literature, the fixing pin and the assembly screw penetrate the side of the lower frame to fix the upper frame. However, in this case, since the fixing pin and the assembly screw are exposed to the outside as it is, there is a risk of contamination or corrosion by the external environment.

Accordingly, there is a need to develop a frame assembly for pistol with an improved structure in order that the lower frame and the upper frame can be easily and strongly assembled and the assembly screw etc. is not exposed to the outside.

PATENT LITERATURE

Patent Literature 1: KR 10-1845051 B1 (Mar. 28, 2018)

Patent Literature 2: U.S. Pat. No. 5,655,326 B1 (Aug. 12, 1997)

Patent Literature 3: U.S. Pat. No. 6,993,864 B1 (Feb. 7, 2006)

Patent Literature 4: U.S. Pat. No. 8,156,677 B2 (Apr. 17, 2012)

Patent Literature 5: US 2014-0007479 A1 (Jan. 9, 2014)

Patent Literature 6: US 2009-0071053 A1 (Mar. 19, 2009)

SUMMARY OF THE INVENTION

The invention is made to solve the problems of a frame assembly for a pistol in the related art described above, and an object of the invention is to provide a frame assembly for a pistol in which a lower frame and an upper frame can be strongly assembled together and a screw for assembling the upper and lower frames is not exposed outside so as to prevent damage from occurring.

Further, another object thereof is to provide a frame assembly for a pistol in which grip panels assembled on both side surfaces of a lower frame can be easily and strongly assembled without using a separate assembly screw.

Furthermore, still another object thereof is to provide a frame assembly for a pistol in which lower frames manufactured in a single type and a double type and upper frames manufactured in 4.25 in., 5 in., and 6 in. can be variously assembled together.

According to an aspect of the invention to achieve the object described above, there is provided a frame assembly for a pistol, the frame assembly including: a lower frame having a grip formed at a lower side; and an upper frame that is assembled on the lower frame and is assembled to a slide, wherein the lower frame has a mounting projection which has a predetermined length and projects upward to a predetermined height in a direction to face the upper frame, wherein the upper frame has a mounting groove which has a predetermined depth and into which the mounting projection is inserted in a direction to face the lower frame, and wherein the lower frame and the upper frame are assembled together by a screw which is fastened to penetrate the mounting groove and the mounting projection in this order from an inner side of the upper frame.

In addition, the mounting projection has fitting grooves which have a predetermined depth and are formed along both side surfaces in a length direction of the mounting projection, the mounting groove has latching projections which project by a predetermined width and are formed along both side surfaces in a length direction of the mounting groove so as to be inserted into the fitting groove, and the upper frame is configured to be seated to come into close contact with the lower frame and then be slid and moved rearward by a predetermined distance such that the mounting projection is fitting-assembled into the mounting groove.

In addition, an upper end of the lower frame has a pair of locking grooves that has a predetermined length in a horizontal direction and faces each other symmetrically, an end of the upper frame has a pair of locking projections which projects from both lower side surfaces of the end by a predetermined width in opposite directions, and the upper frame is seated to come into close contact with the lower frame and then is slid and moved rearward by a predetermined distance such that the pair of locking projections is fitting-assembled into the pair of locking grooves.

In addition, the grip has mounting portions which have a predetermined depth at both side surfaces along a vertical length of the grip, and the mounting portion has a pair of grip panels which are provided to be slid and fitting-assembled in a vertical direction.

In addition, the lower frame is manufactured in a single type or a double type depending on a size of a magazine which can be mounted on the lower frame, the upper frame is manufactured to have a size of 4.25 in., 5 in., and 6 in. depending on a length of a gun barrel, and the lower frame as any one selected from the single type and double type lower frames and the upper frame as any one selected from upper frames of 4.25 in. 5 in. and 6 in. are configured to be assembled together.

BRIEF DESCRIPTION OF THE DRAWINGS

The above and other objects, features and advantages of the present invention will be more apparent from the following detailed description taken in conconfluence with the accompanying drawings, in which.

REFERENCE SIGNS LIST

Figure 1:
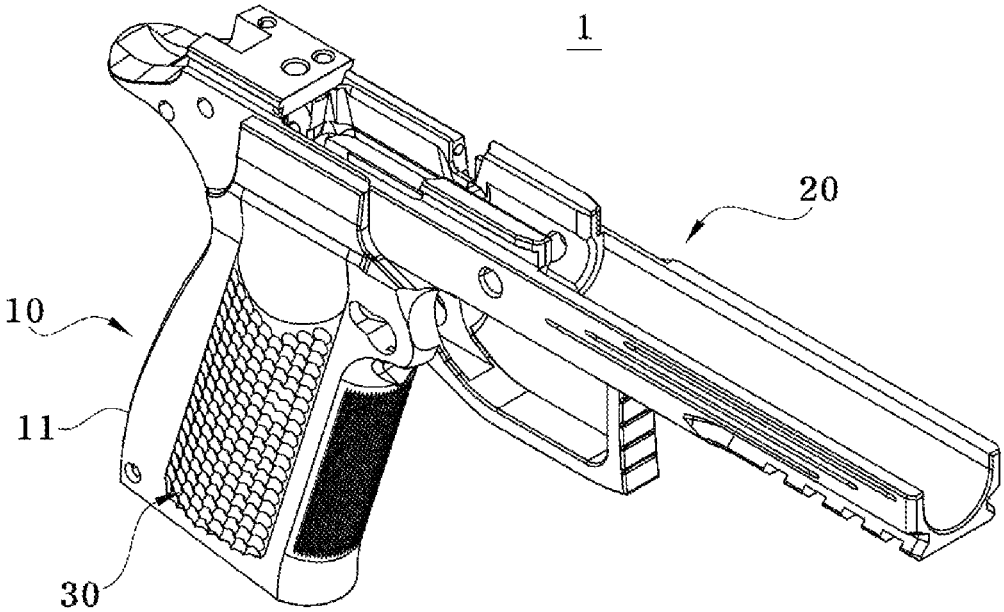
FIG. 1 is a perspective view showing an example of a frame assembly for a pistol according to the present invention.

1: frame assembly for pistol
10: lower frame
11: grip part
12: mounting portions
12A: inclined surfaces
12B: vertical surfaces
13: seating portion
13A: screwing hole
14: trigger guide
15: mounting projection
15A: screwing hole
15B: fitting grooves
16A, 16B: locking grooves
20: upper frame
21: main frame body
22: front rail
23: rear rail
23A: through-hole
24: mounting groove
24B: latching projections
25A, 25B: locking projections
30: grip panels
31: main panel body
32: grip forming portion
33: slide combining portions
33A: inclined surface
33B: perpendicular surface

DETAILED DESCRIPTION OF THE PREFERRED EMBODIMENT

Hereinafter, preferred embodiments according to the invention will be described in detail with reference to the accompanying drawings.

Figure 2:
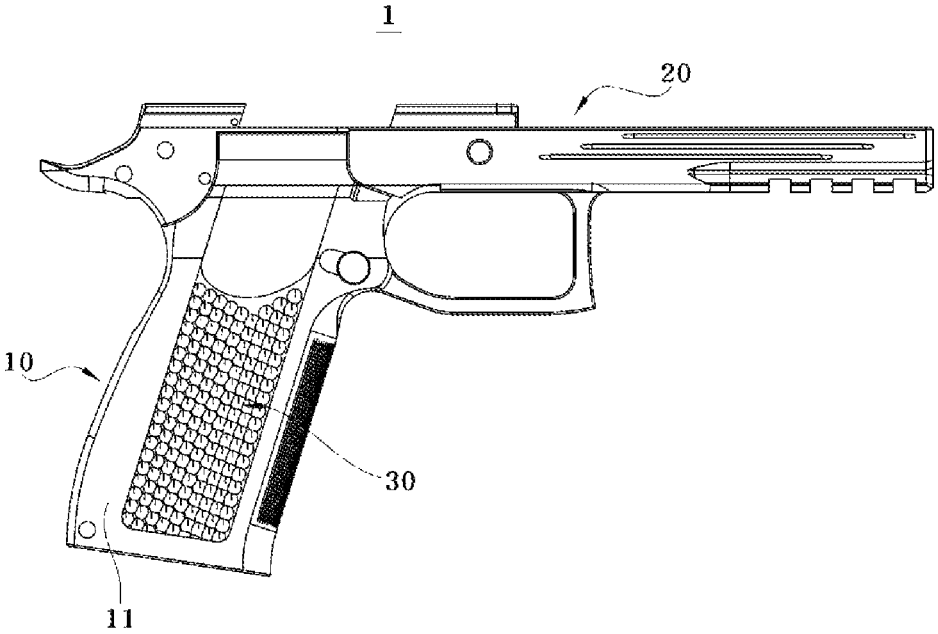
FIG. 2 is a side view of FIG. 1.
Figure 3:
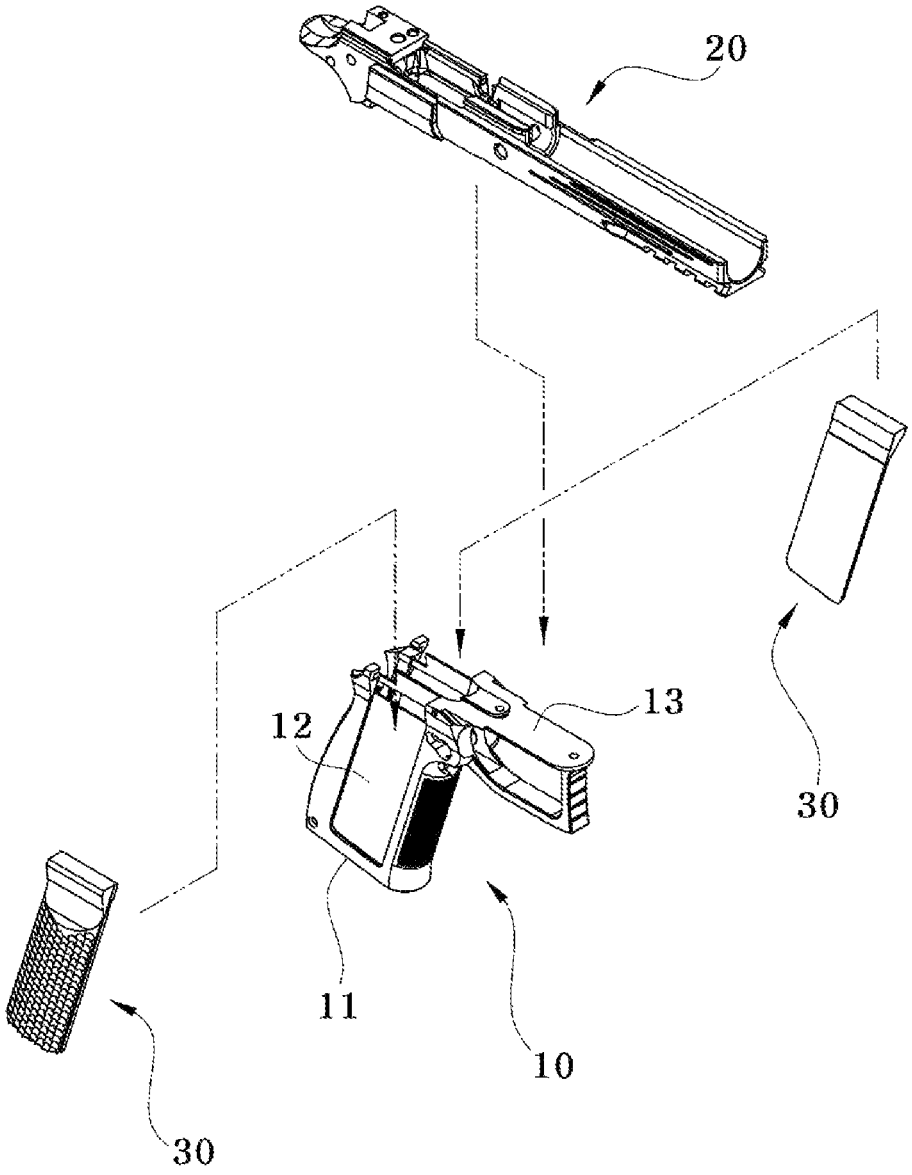
FIG. 3 is an exploded perspective view of FIG. 1.

According to the invention, there is provided a frame assembly for a pistol in which a lower frame and an upper frame can be strongly assembled together and a screw for assembling the upper and lower frames is not exposed outside so as to prevent damage from occurring. In the invention, the frame assembly includes a lower frame (10) and an upper frame (20) as illustrated in FIGS. 1 and 2.

Hereinafter, for convenience of description, a direction in which a muzzle of a pistol points is referred to as a 'front direction', and an opposite direction thereof is referred to as a 'rear direction'.

The lower frame (10) has a configuration for a user to grip a pistol and manipulate a trigger (not illustrated).

The lower frame (10) includes a grip part (11) having a predetermined size which is formed to have a predetermined length vertically such that a user grips the grip part as illustrated in FIGS. 4A to 5B, mounting portions (12) having a predetermined depth which are formed at both side surfaces of the grip part (11), a seating portion (13) having a predetermined width which is extended horizontally along an upper end of the grip part (11) by a predetermined length and projects, a trigger guide (14) which is formed at a bottom of the seating portion (13) and by which the trigger is exposed inside, and a mounting projection (15) having a predetermined length which is provided at a top surface of the seating portion (13) and projects upward to a predetermined height in a direction to face the upper frame (20) to be described below.

Figure 4A:
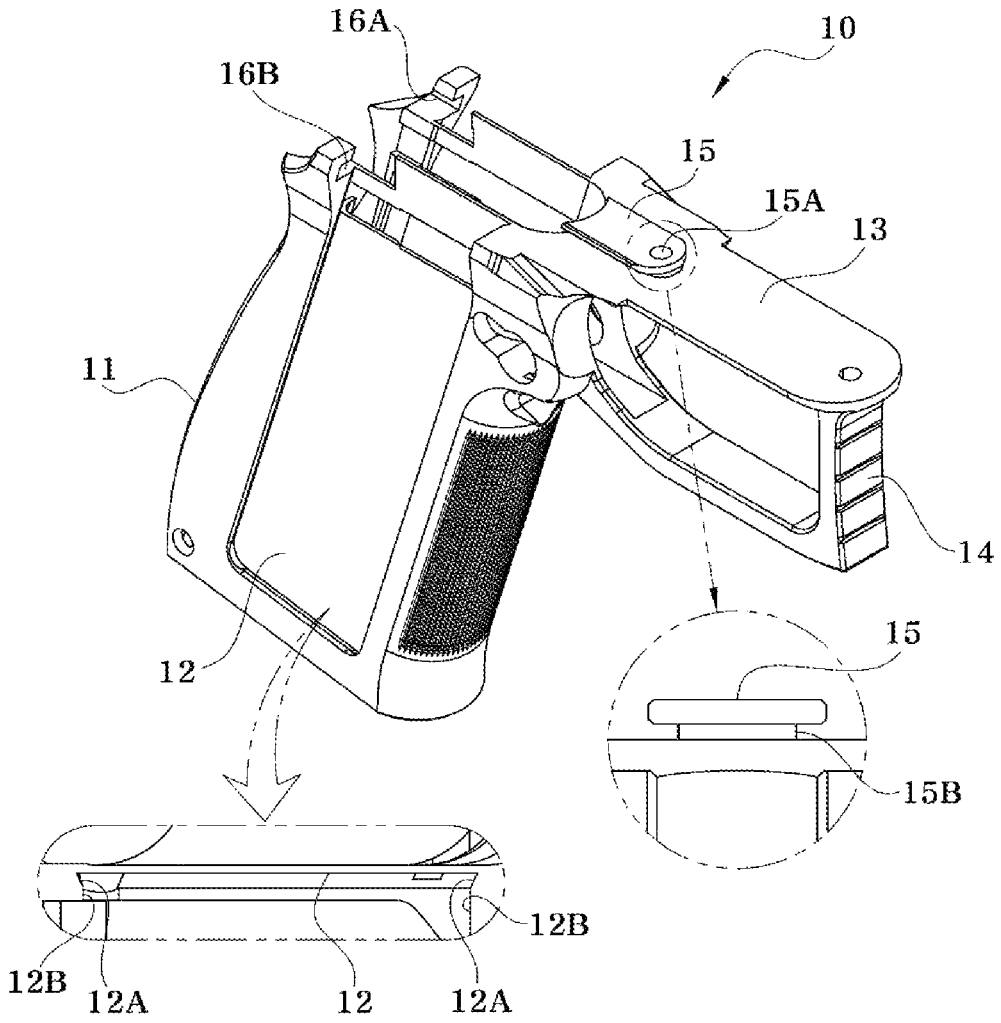
FIG. 4A and FIG. 5A are perspective views showing an example of a single type lower frame according to the present invention.
Figure 4B:
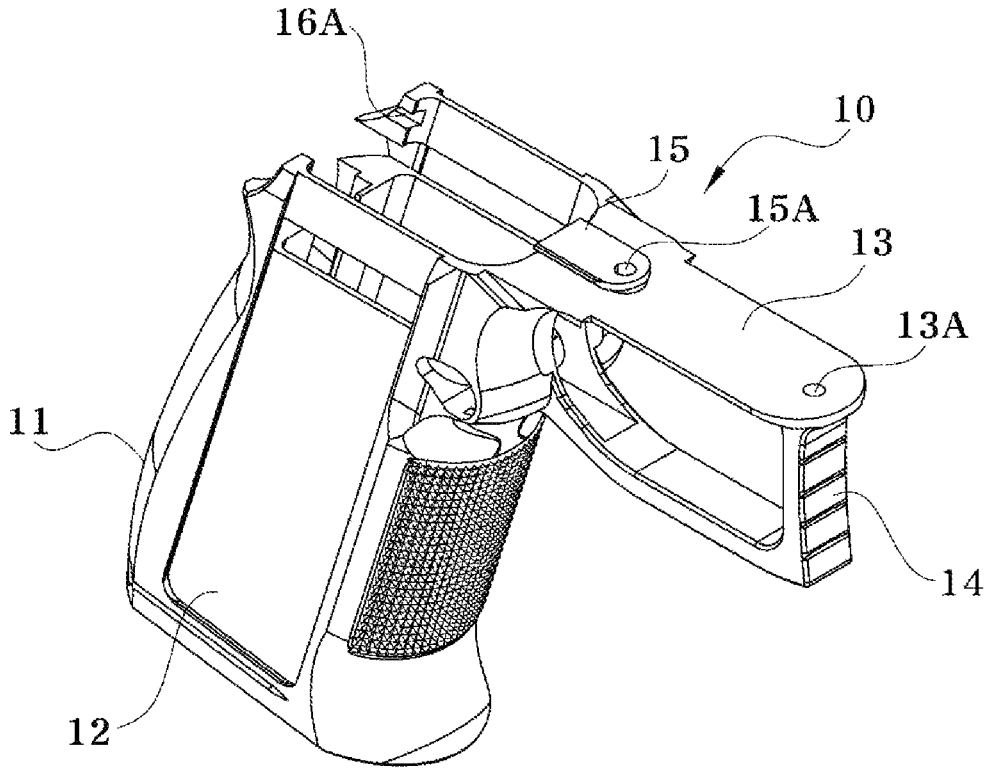
FIG. 4B and FIG. 5B are perspective views showing an example of a double type lower frame according to the present invention.
Figure 5A:
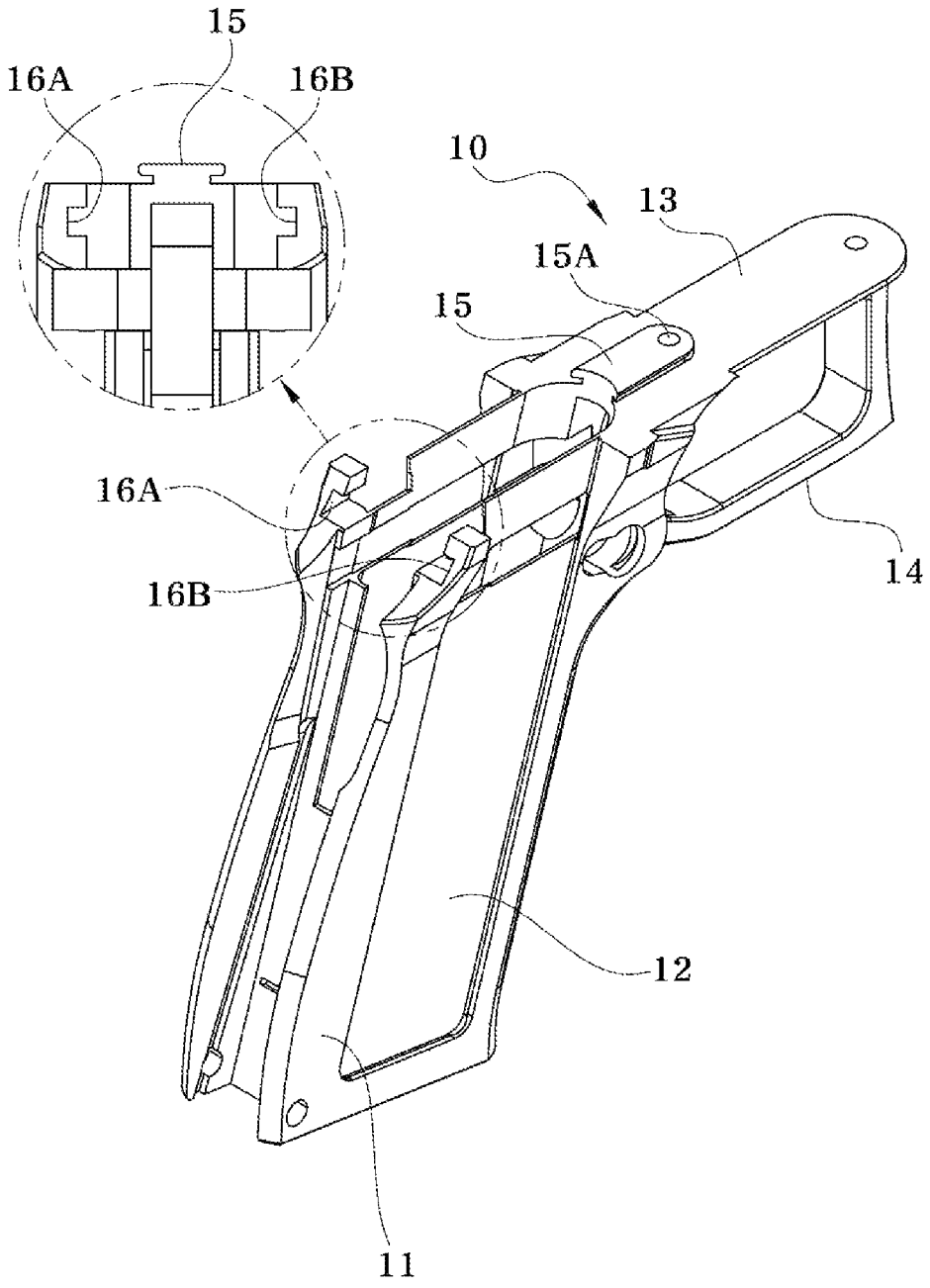
Figure 5B:
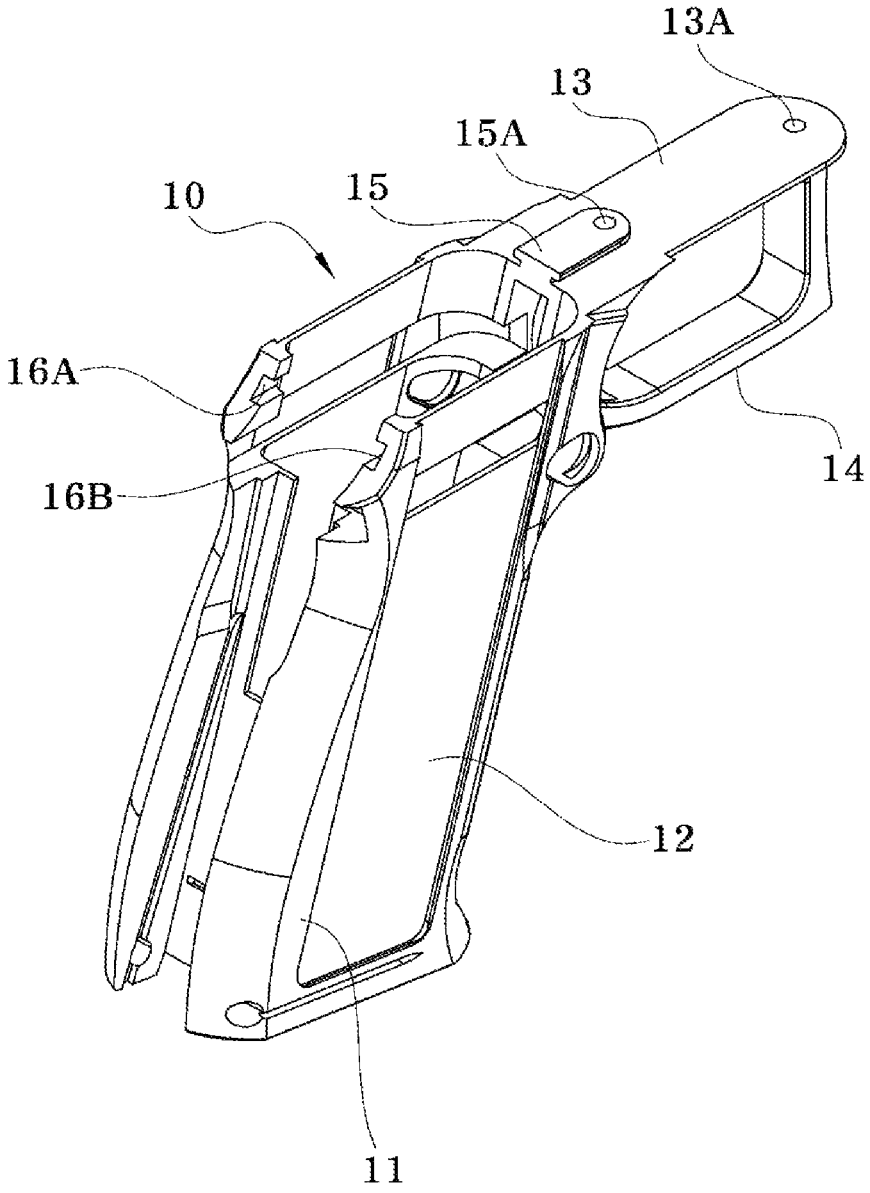

Here, the grip part (11) is manufactured as a single type as illustrated in FIGS. 4A and 5A and a double type as illustrated in FIGS. 4B and 5B depending on a type of magazine which is inserted into a bottom of the grip part (11), and any one selected from the single type and double type lower frames (10) is assembled to the upper frame (20) to be described below.

Besides, as illustrated in FIGS. 4A and 4B, the mounting portions (12) are formed to have a predetermined depth at both side surfaces of the grip part (11), and a top surface of the mounting portion is opened to communicate with a top surface of the lower frame (10).

Further, the mounting portion (12) has inclined surfaces (12A) which face each other at both side surfaces in a vertical length direction and are inclined at an angle of 30° to 70° and vertical surfaces (12B) which are integrally formed at ends of the inclined surfaces (12A) to be extended by a predetermined length and project to be substantially perpendicular to the mounting portion (12).

A configuration of the mounting portion (12) described above allows grip panels 30, which will be described below, to be assembled or disassembled by sliding in a vertical direction through the opened top surface of the mounting portion (12).

The seating portion (13) further has a screwing hole (13A) having a predetermined diameter, and a screw (not illustrated) is fastened into the screwing hole (13A) of the seating portion (13), the screw being fastened from an inner side of the upper frame (20), which will be described below, in a state where the upper frame (20) is assembled.

Further, the mounting projection (15) is formed to have a predetermined length in a front-rear direction, and a top surface of the mounting projection has a screwing hole (15A) having a predetermined diameter. A screw (not illustrated) is assembled from the inner side of the upper frame (20) toward the screwing hole (15A) through the screwing hole (15A) in a state where the upper frame (20) is assembled to come into close contact with the lower frame (10), and thereby the lower frame (10) and the upper frame (20) are strongly assembled together.

Here, the mounting projection (15) has fitting grooves (15B) which are formed to have a predetermined depth at both side surfaces in a length direction of the mounting projection as illustrated in FIG. 4A. In this configuration, the upper frame (20) is configured to slide through the fitting grooves (15B) by a predetermined distance in a horizontal direction such that latching projections (24B) of a mounting groove (24) to be described below are inserted into the fitting groove (15B). In this manner, in addition to screwing, the lower frame (10) and the upper frame (20) are more strongly assembled to come into closer contact with each other.

An upper end (one end at a rear side) of the lower frame (10) further has a pair of locking grooves (16A and 16B) that has a predetermined length in a horizontal direction and faces each other symmetrically as illustrated in FIGS. 5A and 5B, and locking projections (25A and 25B) of the upper frame (20) to be described below slide to be inserted into the pair of locking grooves (16A and 16B) such that the lower frame (10) and the upper frame (20) are more strongly combined.

The upper frame (20) is configured to be assembled on the lower frame (10) and is combined with a slide (not illustrated) which moves by sliding.

Figure 6:
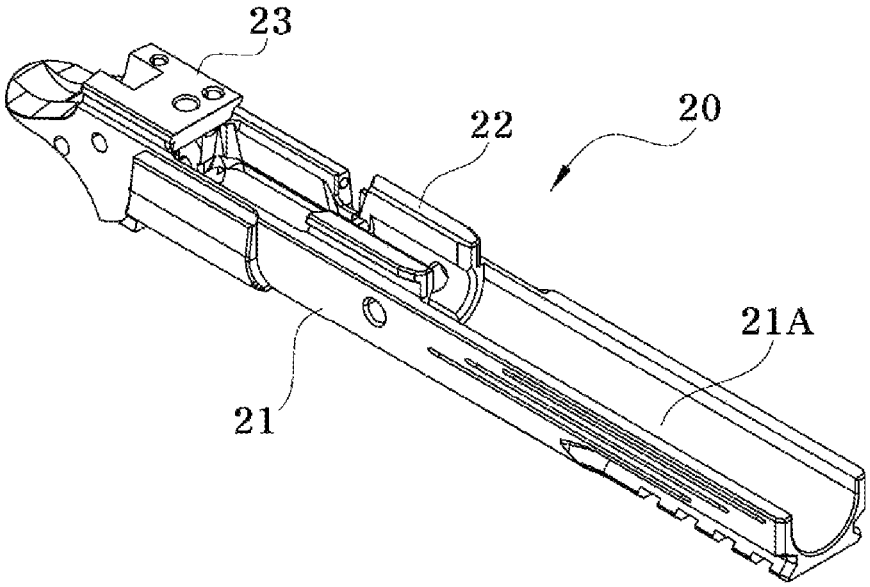
FIG. 6 and FIG. 7 are perspective views showing an example of an upper frame according to the present invention.
Figure 7:
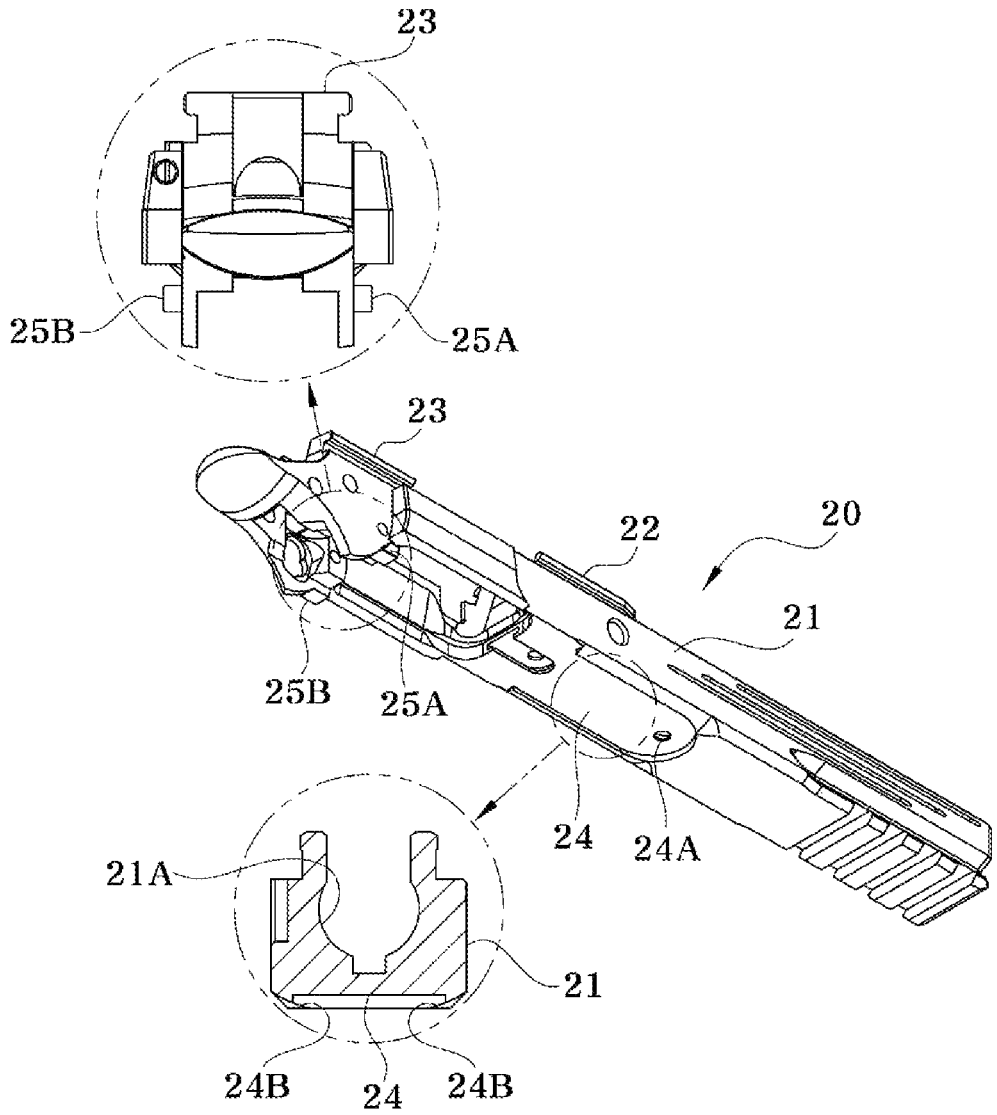

The upper frame (20) includes a main frame body (21) which is manufactured to have a length of gun barrel of 4.25 in., 5 in., and 6 in. and has a predetermined length horizontally as illustrated in FIGS. 6 and 7, a front rail (22) which is positioned at a central portion of a top surface of the main frame body (21) and is formed to project so as to be assembled to the slide, a rear rail (23) which is positioned at a rear side of the upper surface of the main frame body (21) and is formed to project so as to be assembled to the slide, and a mounting groove (24) having a predetermined depth which is positioned at a bottom of the main frame body (21) and into which the mounting projection (15) of the lower frame (10) is inserted by sliding.

Here, the main frame body (21) has a loading spring installing groove (21A) having a predetermined diameter at a front side of the top surface of the main frame body.

The main frame body (21) further has a through-hole (23A) having a predetermined diameter which penetrates upper and lower surfaces to be coincident with a position of the screwing hole (15A) of the lower frame (10) as illustrated in FIG. 7.

Further, the mounting groove (24) having a predetermined depth has a pair of latching projections (24B) which projects from both side surfaces of the mounting groove by a predetermined width in facing directions and which slides to be inserted into the fitting groove (15B) of the mounting projection (15).

Besides, the main frame body (21) has a pair of locking projections (25A and 25B) which projects from both lower side surfaces at a rear side of the main frame body (21) by a predetermined width in opposite directions of each other. The upper frame (20) is slid in the horizontal direction, and thereby the pair of locking projections (25A and 25B) are inserted into the locking grooves (16A and 16B) of the lower frame (10) such that the rear side of the main frame body (21) is fixed.

In the frame assembly for a pistol of the invention having a configuration as described above, a bottom of the upper frame (20) is seated to come into close contact with the seating portion (13) of the lower frame (10) and then is slid and moved rearward by a predetermined distance such that the mounting projection (15) is easily inserted into the mounting groove (24). At the same time, the locking projections (25A and 25B) of the upper frame (20) are inserted into the locking grooves (16A and 16B) of the lower frame (10), and thereby the lower frame (10) and the upper frame (20) are strongly assembled together only by a sliding assembly structure.

In a state where the lower frame (10) and the upper frame (20) are assembled together, a screw is assembled to penetrate the through-hole (23A) and the screwing hole (15A) in this order from an inner side of the upper frame (20), and thereby the lower frame (10) and the upper frame (20) are more strongly assembled together doubly. Then, the slide is combined with the upper frame (20), and thereby the screw positioned at the inner side of the upper frame (20) is not exposed outside structurally.

Figure 8:
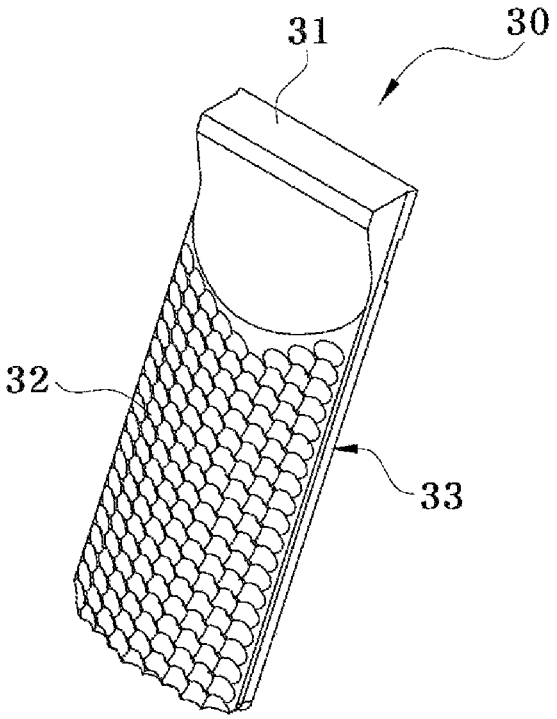
FIG. 8 is a perspective view showing an example of a grip panel according to the present invention.
Figure 9:
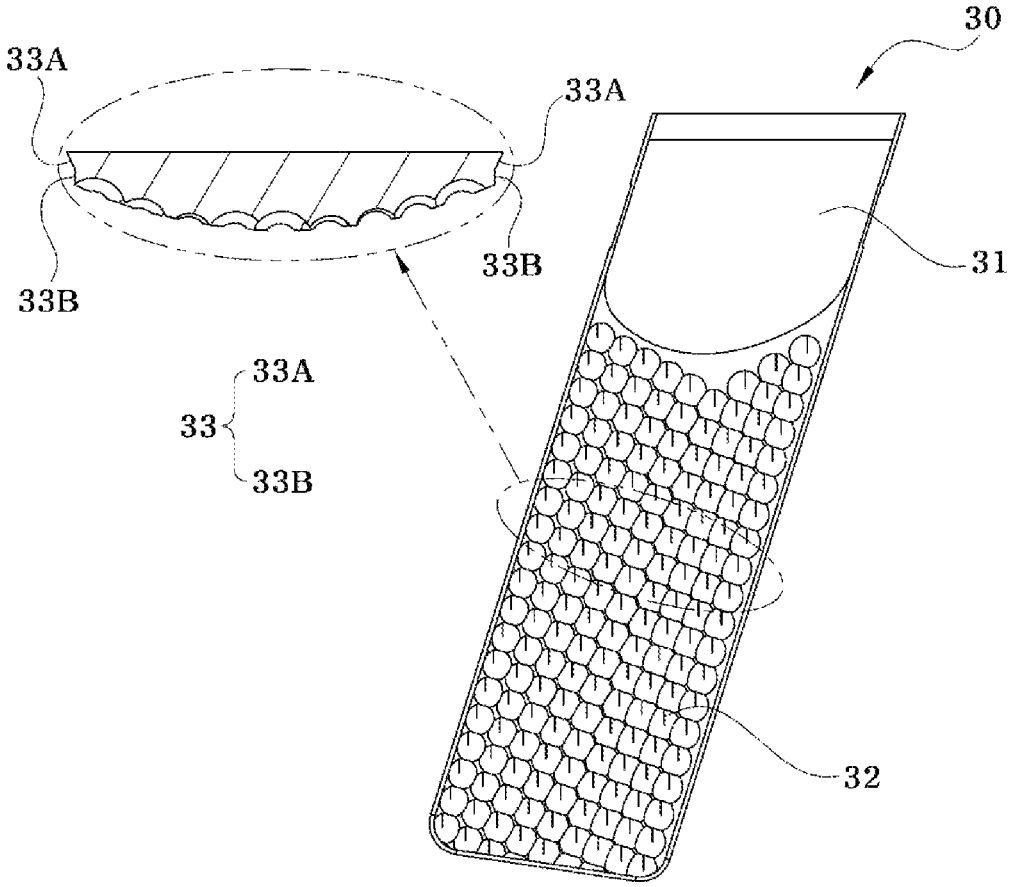
FIG. 9 is a front view showing an example of grip panels according to the present invention.

Meanwhile, the grip panels (30) which are vertically sliding-assembled at the mounting portion (12) of the lower frame (10) includes a main panel body (31) which has a flat surface at one side facing the mounting portion (12) as illustrated in FIGS. 8 and 9 and a surface having an arc shape with a predetermined diameter at the other side with which a hand of a user comes into contact unlike the flat surface, a grip forming portion (32) formed to have a plurality of grooves and projections on the surface at the other side of the main panel body (31), and slide combining portions (33) which are formed along both side surfaces of the main panel body (31).

Besides, the slide combining portion (33) has an inclined surface (33A) at a predetermined angle and a perpendicular surface (33B) having a predetermined width, in which the inclined surface (33A) corresponds to the inclined surface (12A) of the mounting portion (12), and the perpendicular surface (33B) corresponds to the perpendicular surface (12B) of the mounting portion (12). The grip panel (30) can be easily assembled only by sliding and inserting the grip panel (30) in a downward direction from above of the mounting portion (12) when the grip panel (30) is assembled to the lower frame (10) through the slide combining portion (33). At the same time, the inclined surfaces (12A and 33A) and the perpendicular surfaces (12B and 33B) of the mounting portion (12) and the slide combining portion (33) come into close contact with each other, and thus the grip panel (30) does not move separately.

After the pair of grip panels (30) is assembled to both mounting portions (12) of the lower frame (10), the upper frame (20) is seated to be assembled to the seating portion (13) of the lower frame (10). As a result, the opened top surface of the mounting portions (12) of the lower frame (10) is covered with the upper frame (20), and thus the grip panels (30) are structurally prevented from being randomly separated from the positions thereof.

According to the invention, the following advantage is obtained. An upper frame provided on a lower frame is fitting-assembled together by sliding and moving horizontally by a predetermined distance due to a structure of a mounting projection and a mounting groove. In that state, a screw is fastened from an inner side of the upper frame toward the mounting projection of the lower frame such that the upper and lower frames are combined with each other. Hence, the lower frame and the upper frame can be easily and strongly combined with each other while not exposing the screw outside a pistol barrel.

Further, the following advantage is obtained. The lower frame is manufactured as a single type and a double type depending on a type of magazine which is inserted therein, and the upper frame is variously assembled to have a size of 4.25 in., 5 in., and 6 in. depending on a length of a gun barrel.

Further, the following advantage is obtained. A pair of grip panels is combined by sliding in a downward direction from above at both sides of the lower frame, and in that state, the upper frame is combined on the lower frame. Thus, the grip panels can be easily fixed without using a separate fastening member such as a screw.

In the above, for the convenience of explanation, the drawings showing the preferred embodiments and the configurations shown in the drawings have been described with reference numerals and names. However, as an embodiment according to the present invention, the scope of the invention should not be interpreted as it is limited to the shapes shown in the drawings and the names given. While the present invention has been described with respect to the specific embodiments, it will be apparent to those skilled in the art that various changes and modifications may be made without departing from the spirit and scope of the invention as defined in the following claims.

What is claimed is:

1. A frame assembly for a pistol, the frame assembly (1) comprising:

a lower frame (10) having a grip (11) formed at a lower side; and an upper frame (20) that is assembled on the lower frame and is assembled to a slide, wherein the lower frame (10) has a mounting projection (15) which has a predetermined length and projects upward to a predetermined height in a direction to face the upper frame (20), wherein the upper frame (20) has a mounting groove (24) which has a predetermined depth and into which the mounting projection (15) is inserted in a direction to face the lower frame (10), and wherein the lower frame (10) and the upper frame (20) are assembled together by a screw which is fastened to penetrate the mounting groove (24) and the mounting projection (15) in this order from an inner side of the upper frame (20).

2. The frame assembly for a pistol according to claim 1, wherein the mounting projection (15) has fitting grooves (15B) which have a predetermined depth and are formed along both side surfaces in a length direction of the mounting projection, wherein the mounting groove (24) has latching projections (24B) which project by a predetermined width and are formed along both side surfaces in a length direction of the mounting groove so as to be inserted into the fitting groove (15B), and wherein the upper frame (20) is configured to be seated to come into close contact with the lower frame (10) and then be slid and moved rearward by a predetermined distance such that the mounting projection (15) is fitting-assembled into the mounting groove (24).

3. The frame assembly for a pistol according to claim 2, wherein an upper end of the lower frame (10) has a pair of locking grooves (16A and 16B) that has a predetermined length in a horizontal direction and faces each other symmetrically, wherein an end of the upper frame (20) has a pair of locking projections (25A and 25B) which projects from both lower side surfaces of the end by a predetermined width in opposite directions, and wherein the upper frame (20) is seated to come into close contact with the lower frame (10) and then is slid and moved rearward by a predetermined distance such that the pair of locking projections (25A and 25B) is fitting-assembled into the pair of locking grooves (16A and 16B).

4. The frame assembly for a pistol according to claim 1, wherein the grip (11) has mounting portions (12) which have a predetermined depth at both side surfaces along a vertical length of the grip, and wherein the mounting portion (12) has a pair of grip panels (30) which are provided to be slid and fitting-assembled in a vertical direction.

5. The frame assembly for a pistol according to claim 1, wherein the lower frame (10) is manufactured in a single type or a double type depending on a size of a magazine which can be mounted on the lower frame, wherein the upper frame (20) is manufactured to have a size of 4.25 in., 5 in., and 6 in. depending on a length of a gun barrel, and wherein the lower frame (10) as any one selected from the single type and double type lower frames and the upper frame (20) as any one selected from upper frames of 4.25 in. 5 in. and 6 in. are configured to be assembled together.

* * * * *